US007324001B2

(12) United States Patent
Crisman

(10) Patent No.: US 7,324,001 B2
(45) Date of Patent: Jan. 29, 2008

(54) SYSTEM AND METHOD FOR DETECTING AND DISCRIMINATING BETWEEN WATER AND ICE FORMATION ON OBJECTS

(75) Inventor: Everett E. Crisman, Woonsocket, RI (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 187 days.

(21) Appl. No.: 11/217,840

(22) Filed: Aug. 29, 2005

(65) Prior Publication Data

US 2007/0046478 A1 Mar. 1, 2007

(51) Int. Cl.
*G08B 19/02* (2006.01)

(52) U.S. Cl. ..... 340/580; 340/583; 340/962

(58) Field of Classification Search ..... 340/580–583, 340/962; 244/134 R, 134 D; 250/222.1
See application file for complete search history.

(56) References Cited

U.S. PATENT DOCUMENTS 4,808,824 A * 2/1989 Sinnar ..... 250/339.11
5,218,206 A * 6/1993 Schmitt et al. ..... 250/339.11
5,596,320 A * 1/1997 Barnes ..... 340/962
5,962,853 A * 10/1999 Huth-Fehre et al. ... 250/339.11
6,049,387 A * 4/2000 Griesinger ..... 356/419
2001/0048078 A1* 12/2001 Stair et al. ..... 250/340

* cited by examiner

*Primary Examiner*—Jeffery Hofsass
*Assistant Examiner*—Hoi C. Lau
(74) *Attorney, Agent, or Firm*—AFMCLO/JAZ; Robert V. Klauzinski

(57) ABSTRACT

A system for detecting and discriminating between water and ice formation on a number of objects, such as aircraft or roadways is described. The system includes an optical element or sensor adapted to receive at least first and second wavelengths of light from a multi-wavelength light source and for outputting attenuated versions of the first and second wavelengths of light. A detector senses and converts the attenuated versions of the first and second wavelengths of light to electrical signals proportional to the light intensities of the first and second wavelengths of light. A processor is coupled to receive and process the electrical signals for determining one or more light intensity values and for actuating one or more indicators corresponding to one of a number of predetermined states of operation of the optical element, including a normal state of operation, a rain state of operation and/or an ice state of operation.

14 Claims, 3 Drawing Sheets

SYSTEM AND METHOD FOR DETECTING AND DISCRIMINATING BETWEEN WATER AND ICE FORMATION ON OBJECTS

STATEMENT OF GOVERNMENT INTEREST

The invention described herein may be manufactured and used by or for the Government for governmental purposes without the payment of any royalty thereon.

FIELD OF THE INVENTION

The present invention relates generally to weather condition sensors and, more particularly, to a system and method for detecting and discriminating between water and ice formation on any one of a number of objects, such as wings of an aircraft, roadway surfaces, bridges and the like.

BACKGROUND OF THE INVENTION

As is known, ice build up on air frames and control surfaces of aircraft increases weight, reduces lift and significantly contributes to a number of airplane accidents each year. Clear ice is particularly insidious since it cannot be readily observed on aircraft surfaces until significant accumulation has occurred. Presently, there are several methods for removing ice from aircraft, both on the ground and during flight. On the ground, de-icing agents (e.g., alcohols) may be sprayed onto the surface of the aircraft from mobile tanks. Ground de-icing is designed to facilitate takeoff and provides a temporary reduction in ice formation. In the air, expansion boots, de-icing sprays and heating elements are typically employed to reduce ice formation. However, most of the in-flight deicing mechanisms are for specific parts of the aircraft, i.e. windshields, propellers and wings. The propellers and wings of the aircraft are usually the places where ice will precipitate first. During sustained flight in icing conditions, most air frame surfaces accumulate ice to a greater or lesser extent. Further, detecting the presence of ice on the aircraft is usually accomplished by visual inspection of a pilot, which can be limited by unfavorable visibility caused by window fogging, darkness, human error and/or other visual limitations. In particular, the initial buildup of transparent "clear" ice is particularly difficult to determine.

Similarly, clear ice, otherwise known as "black" ice, may build up on roadways, bridges and the like, contributing to hazardous driving conditions for the uninformed motorist. Black ice formed on roadways is very difficult to detect in advance and automobile operators often realize this slippery roadway condition when it is too late. Surfaces of bridges are also well known to accumulate ice before roadways.

Thus, a need remains for a system that can monitor for icing conditions on various objects and provide advanced warning of potential safety issues.

SUMMARY OF THE INVENTION

In one aspect the present invention includes a system for detecting and discriminating between water and ice formation on an object. The system includes a multi-wavelength light source adapted to output at least first and second light beams having respective first and second wavelengths of light. The system further includes an optical element mounted on the object. The optical element includes an input coupled to receive at least the first and second light beams from the multi-wavelength light source and an output adapted to provide attenuated versions of the first and second light beams. A detector is operative to receive and process the attenuated versions of the first and second light beams to provide corresponding first and second signals having predetermined characteristics representative of the attenuated versions of she first and second light beams. A processor is coupled to receive and process the first and second signals to provide a light intensity value based on a predetermined ratio of the first and second signals, wherein based on predetermined characteristics of the light intensity value, the processor is operative to actuate any one of a number of indicators corresponding to one of a number of predetermined states of operation of the optical element mounted on the object.

In another aspect, the present invention includes a method for detecting and discriminating between water and ice formation on an optical element which is mounted on an object. The method includes exposing the optical element to weather conditions while passing at least first and second beams of light through the optical element to provide attenuated versions of the first and second beams of light at an output of the optical element. The first beam of light includes a first wavelength of light and similarly the second beam of light includes a second wavelength of light, which may be different from the first wavelength of light.

The method further includes responding to detection of the attenuated versions of the first and second beams of light using a detector by providing respective first and second signals having predetermined characteristics representative of the attenuated versions of the first and second beams of light. The first and second signals may be received and processed at a processor to provide a first light intensity value. If the first light intensity value corresponds to a first predetermined light intensity range, the processor is operative to declare a state of normal operation. If the first light intensity value corresponds to a second predetermined light intensity range, the processor is operative to declare a state of water present on the optical element. If the first light intensity value corresponds to a third predetermined light intensity range, the processor is operative to declare a state of ice present on the optical element.

BRIEF DESCRIPTION OF THE DRAWINGS

The invention will be more fully understood from the following detailed description taken in conjunction with the accompanying drawings, in which.

DETAILED DESCRIPTION OF THE INVENTION

For the purpose of the descriptions below it will be assumed that the term ice refers to clear ice, i.e., a solid, optically transparent, continuous substance. Rime ice, which is a matrix of interconnected microscopic ice crystals with large amounts of void space incorporated therein, is assumed to have light absorption properties equivalent to rain-free air.

Although rime ice often accumulates on airframes and roadways, its appearance (snow-like) is much more readily identified and so poses less of a safety issue.

The present invention provides a system for detecting and discriminating between water and ice formation on any one of a number of objects, as well as a method for accomplishing same. The system for detecting and discriminating between water and ice formation may be incorporated into a number of objects including the wing of an aircraft, the surface of a roadway, the surface of a bridge and/or the like, for providing an advanced warning to users that ice may be forming or that ice may already be present on such objects for permitting the users to take necessary safety precautions.

Figure 1:
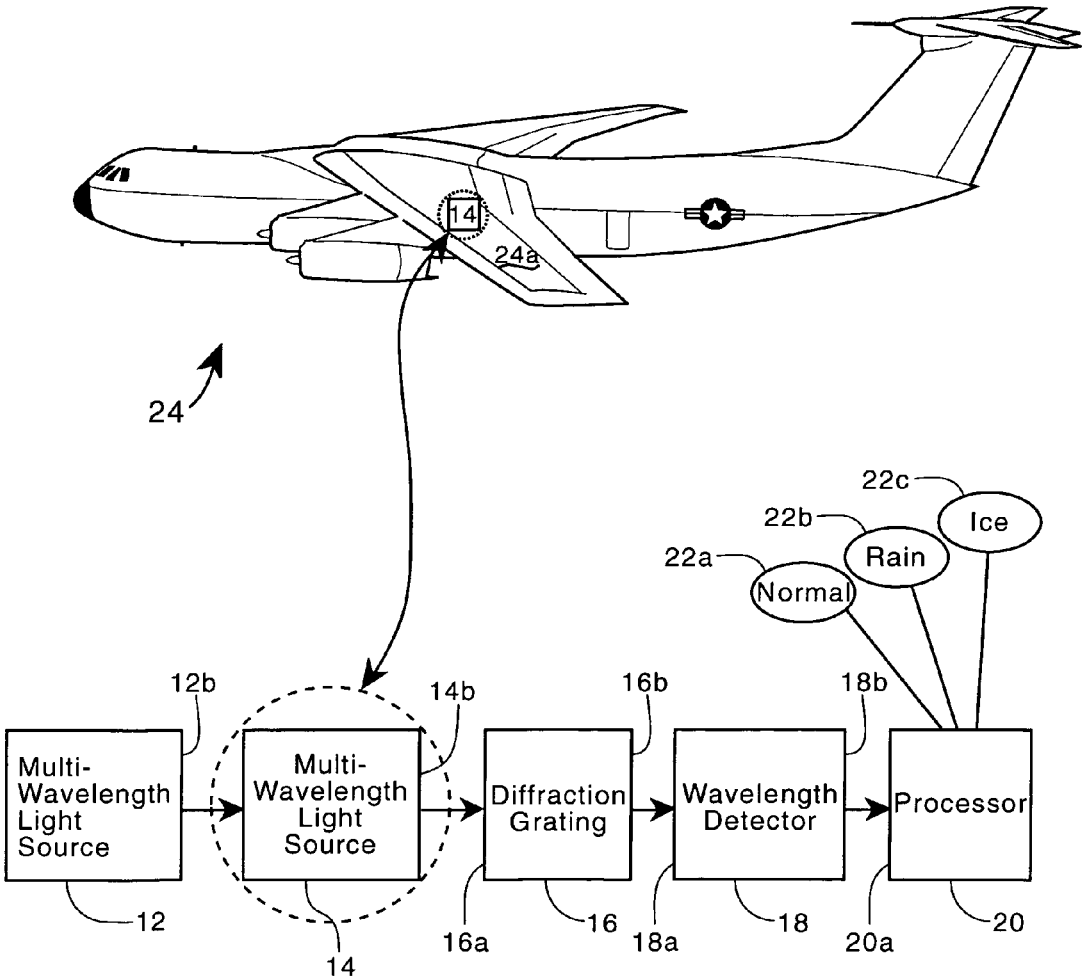
FIG. 1 shows an embodiment of the system for detecting and discriminating between water and ice formation on an object in accordance with the present invention.

Referring now to FIG. 1, shown is one embodiment of the system for detecting and discriminating between water and ice formation on an object 10 in accordance with principles of the present invention. In the illustrative embodiment, the system for detecting and discriminating between water and ice formation on an object 10 includes a multiple-wavelength light source 12 having an output 12*b* coupled to the input 14*a* of an optical element 14 or sensor. The optical element 14 or sensor is adapted for exposure to the ambient and for sensing various weather condition states by sensing dry conditions, rain conditions and/or ice formation conditions on the optical element 14, as will be described in further detail below. The optical element 14 further includes an output 14*b* which is coupled to an input 16*a* of a diffraction grating 16.

In an embodiment, the diffraction grating 16 may include a prism, optical spectrometer or other similarly constructed and arranged optical element adapted for receiving an incident light beam including many wavelengths of light and being operative to (capable of) separating the many wavelengths of light into separate and distinct light beams with each light beam including a separate and distinct wavelength of light. An output 16*b* of the diffraction grating 16 is coupled to an input 18*a* of a wavelength detector 18.

The wavelength detector 18 is adapted to respond to the receipt of the number of separate and distinct light beams, which each include a separate end distinct wavelength of light, by providing a corresponding output signal or pulse representative of the detected one or more predetermined wavelengths of light. In one embodiment, the detector is operative to receive and process attenuated versions of the first and second light beams to provide corresponding first and second signal having predetermined characteristics representative of the light intensity values of the attenuated versions of the first and second light beams. In another embodiment, the wavelength detector responds to receipt of a first light beam having a wavelength of approximately 2 μm (e.g., beam "A," which is described below in connection with FIG. 2) by providing an output signal or pulse having predetermined characteristics representing a flat light intensity value. Similarly, the wavelength detector also responds to receipt of a second light beam having a wavelength of approximately 3 μm (e.g., beam "B," which is also described below in connection with FIG. 2) by providing an output signal or pulse having predetermined characteristics representing a second light intensity value. In an embodiment, the predetermined characteristics of the output signal or pulse provided by the wavelength detector representing each of the first and second light intensity values may include higher or lower signal or pulse amplitudes tint correspond to whether or not the first and/or second light beams have been attenuated and to provide the magnitude of any attenuation. In other words, the first and second signals provided at the output of the detector 18 may include amplitudes proportional to respective light intensities of the first and second light beams received at the input of the detector 18. The signals or pulses and corresponding predetermined characteristics may be received and processed by the microprocessor 20 to accurately determine the state of operation of the optical element 14, and to actuate the appropriate indicator 22*a*, 22*b*, 22*c*, as described below.

A microprocessor 20 is coupled to receive and process the electrical signal or pulses provided by the wavelength detector 18 and is operative to actuate an appropriate visual indicator 22*a*, 22*b*, 22*c* to alert an operator of the system 10 as to the existence of a state of normal operation (e.g., dry conditions on the optical element 14), a stare of water present (e.g, rain or other water present on the optical element 14) or a state of ice present (e.g., ice present on the optical element 14). As will be described in greater detail below, suffice it to say here that in one embodiment, the microprocessor 20 is coupled to receive and process the first and second signals using the ratio of the first and second signals, wherein based on the ratio value, the processor is operative to actuate any one of a number of indicators. In an embodiment, the visual indicators 22*a*, 22*b*, 22*c* may include a number of different audio and or visual indicators such as, colored LEDs, lamps and/or buzzers. In other embodiments, the indicators 22*a*, 22*b*, 22*c* may include an electronic sign operative to inform a number of individuals as to certain weather or icing conditions.

In the illustrative embodiment, the optical element 14 is mounted on a portion of the wing 24*a* of an aircraft 24 (e.g., mounted directly to the thickest point of the cross-section of the air foil wing 24*a*) for monitoring ambient conditions and to provide a pilot of the aircraft (not shown) with information as to the existence of a state of normal operation (e.g., dry conditions on the optical element 14 located on the wing 24*a* of the aircraft 24), a state of water present (e.g., rain or other water present on the optical element located on the wing 24*a* of the aircraft 24) or a state of ice present (e.g., ice present on the optical element located on the wing 24*a* of the aircraft 24). However, it should be readily understood that the optical element 14, as well as the remaining portions of the system 10, may be incorporated into a number of other objects (e.g., road surface), as previously described above, for providing advanced warnings to users, operators and the like as to potentially dangerous conditions due to water and/or ice formation.

Figure 2:
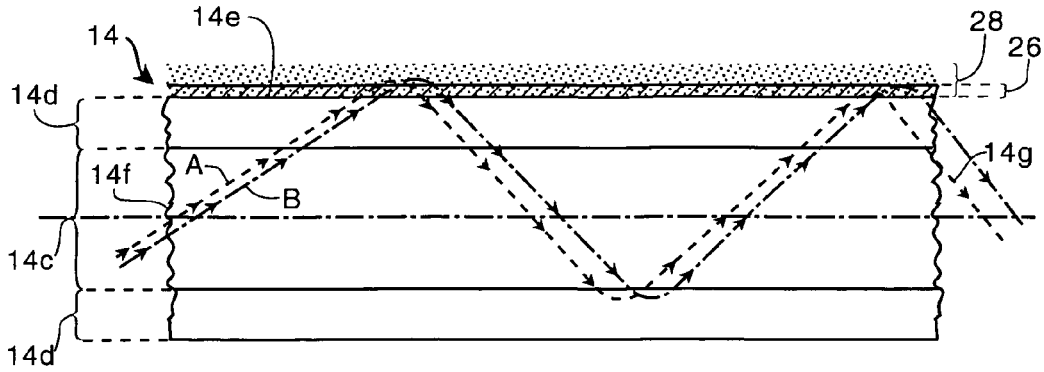
FIG. 2 shows a cross-sectional view of an embodiment of an optical element incorporated on the system of FIG. 1.

Referring to FIG. 2, shown is a cross-sectional view of one embodiment of the optical element 14. The optical element 14 uses the intensity ratios of selected optical wavelengths of light to determine whether ice is accumulating on portions of the optical element 14, as well as on portions of an abject to which the optical element 14 is affixed, such as on aircraft structures or roadways. In an embodiment, the optical element 14 may include a thin slab of optically transparent material (as represented by the cumulative height or thickness of elements 14*c* and 14*d*, which may be on the order of 0.010 inches) that is bonded to the particular structural member for which ice accumulation is to be monitored, e.g., wing 24*a* of the aircraft 24 (FIG. 1). In another embodiment, the optical element 14 may include the dimensions of approximately 1 cm long by 1 mm wide by 0.5 mm thick. The optical element 14 may include a core 14*c* region and a clad region 14*d*, each of which is composed of substantially optically transparent materials, but with the core and clad regions 14*c*, 14*d* having different optical refractive indices.

In an embodiment, the core region 14*c* of the optical element 14 can be constructed of the same glass and/or acrylic materials used far commercial fiber optics and may include an index of refraction of approximately ~4.43. The clad region 14*d* may be formed by coating the core region 14*c* with a transparent material having an index of refraction slightly smaller than the core 14*c* and close to that of water and ice (which refractive index is approximately 1.33), such as an index of refraction of approximately ~1.40, but not close to that of air (which reflective is approximately 1.00). In other embodiments, the optical element 14 may be formed of any light-lossy slab that will couple readily to ice 26 water 28 formed or otherwise disposed on the surface 14*c* of the optical element 14, but not to air when no ice or water is present. Since air has an index of approximately 1 whereas most of the optical fiber materials will have indices around 1.4, the optical element 14 will not as an efficient light confinement medium unless something (water or ice) is present with an index much larger than 1 (water and ice have indices of approximately 1.33 near 0 degrees C.).

An input end 14*f* of the optical element 14 may be provided with a predetermined spectrum of wavelengths of light from the multi-wavelength light source 12 (FIG. 1). In an embodiment, the predetermined spectrum of wavelengths of light include a first light beam (e.g., beam "A") having a wavelength of approximately 2 μm, and a second light beam (e.g, beam "B") having a wavelength of approximately 3 μm. The first and second light beams A, B propagate from the input end 14*f* of the optical element 14 to an output end 14*g* of the optical element 14 for which attenuated versions of the first and second light beams A, B may exit the optical element 14. It should be understood that additional wavelengths of light may also be present, either from the source or from the ambient; however, the additional wavelengths of light may be discarded later by the wavelength detector 18 (FIG. 1).

Figure 3:
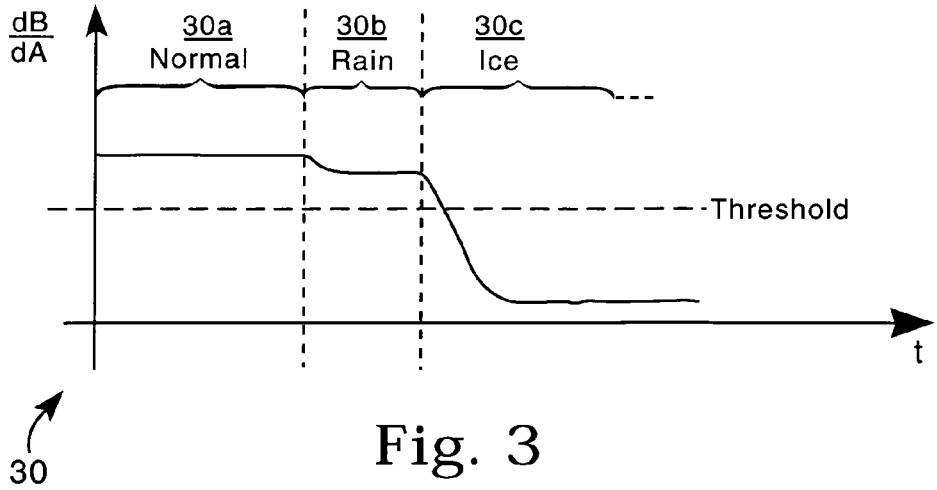
FIG. 3 shows a graph representing a normal state of operation, rain state of operation and an ice state of operation of the system of FIG. 1.

Referring to FIG. 3, shown is a graph 30 representing a state of normal operation 30*a* (e.g., dry conditions on the optical element 14), a state of water present 30*b* (e.g., rain or other water present on the optical element 14) and a state of ice present 30*c* (e.g., ice present on the optical element 14). The state of normal operation 30*a*, the state of water present 30*b* and the state of ice present 30*c* can be determined by processing the first and second attenuated light beams A, B realized at the output end 14*g* of the optical element 14, as described below in detail.

Figure 4:
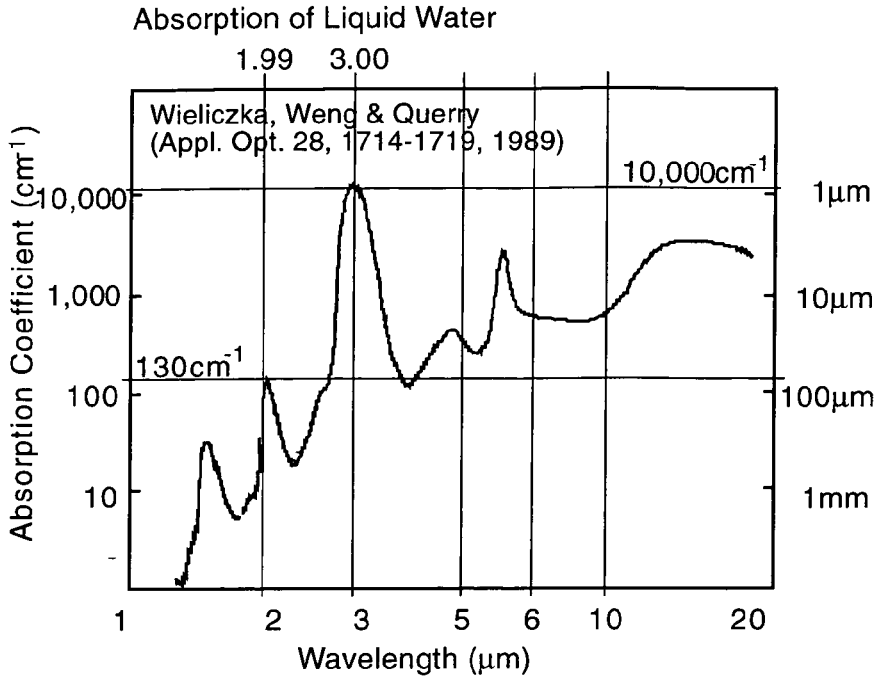
FIGS. 4 and 5 show graphs respectively representing light adsorption of liquid water and light absorption of ice at various wavelengths.
Figure 5:
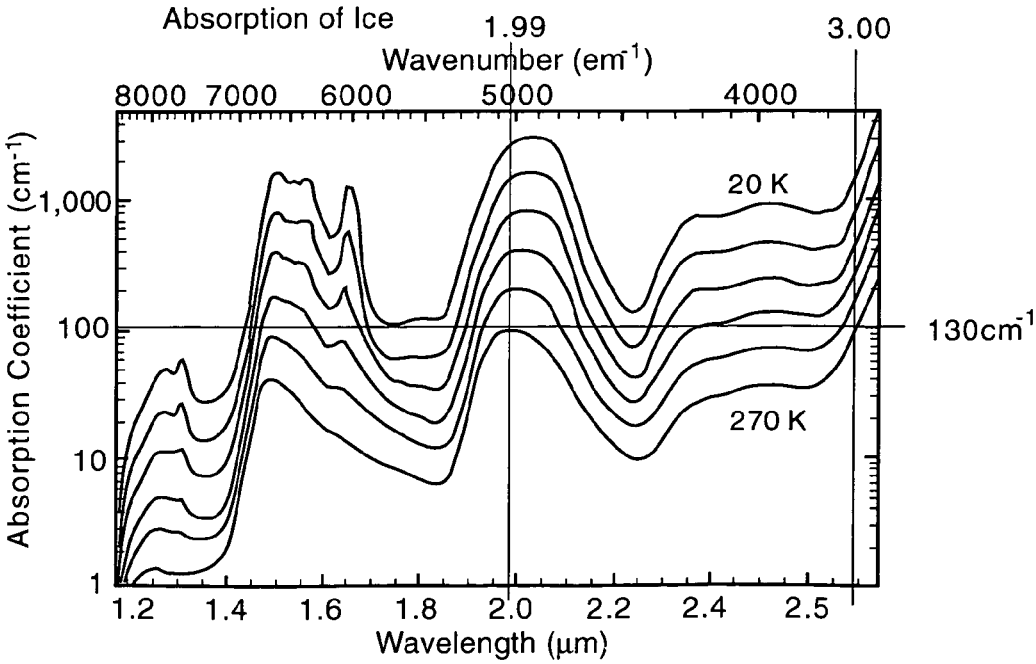

More particularly, ice 26 and water 28 disposed on the optical element 14 absorb light beams differently at different wavelengths. In comparing the ratio of some wavelength of light at which the ice and water 28 absorb light nearly equally to some wavelength of light at which the ice 26 and water 28 absorb light differently, the presence of ice formation should be readily detected. For example, in FIGS. 4 and 5, at a wavelength of approximately 1.99 μm both water and ice have approximately equal absorption coefficients of around 130/cm. However, at a wavelength of approximately 3.00 μm, the absorption coefficient of ice is still around 130/cm whereas the absorption coefficient for water is slightly above 10,000/cm. In this example, there is approximately a factor of 1000 difference.

In the exemplary embodiment, the microprocessor (FIG. 1) is adapted to monitor the ratio of the second light beam, including a wavelength of approximately 3.00 μm to the first light beam including a wavelength of approximately 1.99 μm (i.e., ratio of beams B/A of FIG. 2), for determining a state of operation of the optical element 14 in relation to various weather conditions, e.g., a normal state of operation 30*a* when the optical sensor is dry, a rain state of operation 30*b* when the optical sensor is wet from rain or other precipitation and an icing state of operation 30*c* when the rain or other precipitation begins to freeze on the optical element 14.

In one specific example, if the ratio of the second light beam to the first light beam (i.e., ratio of beams B/A of FIG. 2) is determined to be approximately equal to unity a normal state of operation 30*a* is determined, as shown on the graph of FIG. 3 and the normal state of operation indicator 22*a* of FIG. 1 is actuated by the microprocessor 20. If the ratio of the second light beam to the first light beam is determined to be approximately within the range of 1.00>B/A>0.85, a rain state of operation 30*b* is determined, as shown on the graph of FIG. 3 and the rain state of operation indicator 22*b* of FIG. 1 is actuated by the microprocessor 20. If the ratio of the second light beam to the first light beam is determined to be approximately within the range of 0.85>B/A>0.01, an ice state of operation 30*c* is determined, as shown on the graph of FIG. 3 and the ice state of operation indicator 22*c* of FIG. 1 is actuated by the microprocessor 20. The actual numbers and ranges for the ratio of beams B/A will depend on the selection of the refractive indices of the detector element core and clad portions 14*c*, 14*d*. It should be understood that the ratio of the second beam to the first beam (e.g. beams B/A) is provided for exemplary purposes and it should be readily apparent that the ratio could be redefined to provide for the ratio of the first beam to the second beam (e.g. beams A/B). In either arrangement, there is an abrupt change in the decimal value of the ratio of the first and second light beams A, B, when water 28 formed on the optical element 14 undergoes a phase change to ice 26.

It should be understood that the geometry of the optical element is provided herein for illustrative purposes and other geometries could also be used. Although not specifically provided herein, it should also be readily understood that the optical element may be coated with layer(s) of different refractive index materials that enhance or suppress the attenuation effect of the first and second light beams A, B for specific wavelengths.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A system for detecting and discriminating between water and ice formation on an object comprising:

multi-wavelength light source;

an optical element mounted on the object and having an input coupled to receive at least first and second light beams from the multi-wavelength light source and an output adapted to provide attenuated versions of the first and second light beams;

a detector operative to receive and process the attenuated versions of the first and second light beams to provide corresponding first and second signals having predetermined characteristics representative of light intensity values of the attenuated versions of the first and second light beams; and a processor coupled to receive and process the first and second signals to provide one or more ratio values of the first and second signals, wherein based on the one or more ratio values, the processor is operative to actuate any one of a number of indicators corresponding to one of a number of predetermined states of operation of the optical element mounted on the object as to detecting and discriminating between water and ice formation on the object.

2. The system of claim 1, further including a diffraction grating coupled to receive the attenuated versions of the first and second wavelengths of light from the output of the optical element end being operative to separate the attenuated versions of the first and second wavelengths of light from a plurality of additional wavelengths of light incident from the multi-wavelength light source.

3. The system of claim 1, wherein the optical element includes an optical waveguide having at least a core layer and a clad layer.

4. The system of claim 3, wherein the core layer includes an index of refraction of approximately ~1.48.

5. The system of claim 3, wherein the clad layer includes an index of refraction of approximately ~1.40.

6. The system of claim 3, wherein the optical waveguide includes at least one of a thin sheet of glass; thin sheet of an optical polymer, thin sheet of acrylic, thin sheet of plastic and one or more optical fibers.

7. The system of claim 3, wherein the optical waveguide further includes a highly reflective material disposed on a bottom surface thereof and facing the object to which the optical waveguide is mounted.

8. The system of claim 7, wherein the optical waveguide includes a length ranging from approximately 1 cm to approximately 10 cm, a width ranging from approximately 1 mm to approximately 10 mm and a height ranging from approximately of 0.1 mm to 1 mm.

9. A method for detecting and discriminating between water and ice formation on an optical element mounted on an object, comprising:

(a) exposing the optical element to weather conditions;

(b) passing at least first and second beams of light through the optical element to provide attenuated versions of the first and second beams of light at an output of the optical element;

(c) responding to detection of the attenuated versions of the first and second beams of light by providing respective first and second signals having predetermined characteristics representative of light intensity values of the attenuated versions of the first and second beams of light;

(d) receiving and processing the first and second signals at a processor to provide a ratio value, wherein if the first light intensity value corresponds to a first predetermined light intensity range, declaring a state of normal operation, if the ratio value corresponds to a second predetermined light intensity range, declaring a state of water present on the optical element and if the ratio value corresponds to a third predetermined light intensity range, declaring astate of ice present on the optical element.

10. The method of claim 9, father including:

(e) storing the first light intensity value;

(f) repeating step (d) after a predetermined duration to provide an updated light intensity value; and (g) comparing the first light intensity value and the updated light intensity value to determine if the updated light intensity value is decreasing with respect to the first light intensity value.

11. The method of claim 10, further including:

(h) declaring a transition from a the state of normal operation to the state of water present on the optical element if the updated light intensity value is decreasing with respect to the first light intensity value and if the state of normal operation was earlier declared.

12. The method of claim 10, further including:

(h) declaring a transition from the state of water present on the optical element to the state of ice present on the optical element if the updated light intensity value is decreasing with respect to the first light intensity value and the state of water present on the optical element was earlier declared.

13. The method of claim 10, further including:

(h) declaring a state of increasing ice thickness on the optical element if the updated light intensity value is decreasing with respect to the first light intensity value and if a state of ice present on the optical element was earlier declared.

14. The method of claim 10, further including:

(h) replacing the stored first light intensity value of step (d) with the updated light intensity value; and (i) repeating cyclically at a predetermined frequency steps (e) through (g) to continuously monitor and update a states of the optical element with respect to the weather conditions.

* * * * *